United States Patent [19]

Conner et al.

[11] Patent Number: 4,660,905

[45] Date of Patent: Apr. 28, 1987

[54] MODULAR STORAGE UNITS

[75] Inventors: John P. Conner, Grandville; Terry Mitchell; Craig Miller, both of Jenison; David L. Vander Kooi; Donald Herringa, both of Holland, all of Mich.

[73] Assignee: Trendway Corporation, Holland, Mich.

[21] Appl. No.: 620,129

[22] Filed: Jun. 13, 1984

[51] Int. Cl.[4] ..... A47B 17/00

[52] U.S. Cl. ..... 312/195; 312/108; 248/525

[58] Field of Search ..... 312/194, 195, 245, 246, 312/247, 257 R, 108, 111; 248/225.1, 307, 313; 108/26; 24/298, 525; 403/373, 381

[56] References Cited

U.S. PATENT DOCUMENTS

| | | | |
|---|---|---|---|
| 2,987,362 | 6/1967 | Bernath | 312/257 R |
| 3,469,810 | 9/1969 | Dorris | 24/525 |
| 4,176,889 | 12/1979 | Gartung | 312/195 |

FOREIGN PATENT DOCUMENTS

| | | | |
|---|---|---|---|
| 1118692 | 6/1956 | France | 312/108 |
| 679312 | 9/1952 | United Kingdom | 312/108 |

*Primary Examiner*—Kenneth J. Dorner
*Assistant Examiner*—Gerald A. Anderson
*Attorney, Agent, or Firm*—John A. Waters

[57] ABSTRACT

The present invention comprises a mounting mechanism for releasably mounting a drawer unit under a work surface, wherein the drawer unit comprises a drawer enclosed in a drawer casing. The mounting mechanism comprises an elongated mounting bracket that is mounted transversely on the underside of the work surface. A mating upper drawer casing flange on the drawer casing faces the mounting bracket flange and fits over the mounting bracket flange when the drawer casing is mounted. A releasable retaining means holds the drawer casing flange in overlapping relationship with the mounting bracket flange. Additional drawer units may be releasably mountable on the underside of each drawer unit immediately above it.

9 Claims, 5 Drawing Figures

MODULAR STORAGE UNITS

BACKGROUND OF THE INVENTION

This invention relates to modular drawer units and more particularly to a modular drawer unit system wherein a drawer unit is releasably mounted for transverse position adjustment along the underside of a work surface and additional drawer units are releasably mountable on the underside of each drawer unit immediately above it.

Modular drawer systems are known. However, with most modular systems, it usually is a major project to mount and dismount drawers from the underside of a work surface and to mount and dismount additional drawers from the underside of other drawers. Some systems permit lateral adjustment of drawers along the underside of a work surface. However, mounting and dismounting the drawer systems on the lateral mounting brackets is sometimes difficult and complete removal of the drawers from the brackets is complicated. Moreover, the bracket assemblies are expensive and complex.

An object of the present invention is to provide a simple and very versatile modular storage system wherein individual storage units can be mounted and dismounted for transverse movement on the underside of a work surface easily and where additional storage units can be mounted on the undersides of the first storage units simply and easily by the user of the desk, without requiring the assistance of service personnel.

SUMMARY OF THE INVENTION

The present invention comprises a mounting mechanism for releasably mounting a drawer unit under a work surface, wherein the drawer unit comprises a drawer enclosed in a drawer casing. The mounting mechanism comprises an elongated mounting bracket that is mounted transversely on the underside of the work surface. A transverse mounting bracket flange is spaced below the top of the upper portion and extends outwardly therefrom along one of the elongated sides of the mounting bracket so as to leave a space for a mating upper drawer casing flange in the drawer casing to fit over and rest on the mounting bracket flange.

A mating upper drawer casing flange on the drawer casing faces the mounting bracket flange and is positioned and formed such that it fits over and rests on the mounting bracket flange when the drawer casing is lifted upwardly to the underside of the mounting bracket with the flanges separated and then slid toward the mounting bracket so that the flanges overlap.

A releasable retaining means holds the drawer casing flange in overlapping relationship with the mounting bracket flange and prevents the flanges from slipping apart. The retaining means can be manually released to permit the removal of the drawer casing from the mounting bracket by sliding the flanges apart in a direction perpendicular to the elongated side of the mounting bracket.

Desirably the retainer mechanism is a clamp extending between the drawer casing and the mounting bracket (on the work surface) that holds the two flanges in interlocking relationship, with the clamp being releasable to permit removal of the drawer casing. The clamp also can be loosened to permit transverse movement of the drawer casing along the mounting bracket flange without removing the drawer casing from the mounting bracket.

An important feature of the present invention is that the clamp can be operated simply by means of a single locking screw that is accessible to the desk user. In the preferred practice of the present invention, the mounting bracket flange extends forwardly toward the front of a working surface, and the drawer casing flange extends rearwardly. The mounting bracket includes a downwardly extending lip at a rear edge thereof. The clamp comprises a threaded locking screw rotatably mounted in a fixed axial position at the front of the drawer casing and a clamp bracket that is mounted on the locking screw by a threaded opening therein. The clamp bracket is nonrotatably mounted so that it moves axially as the locking screw is turned. A rear portion of the clamp bracket has an upwardly extending lip that fits over the downwardly extending lip at the rear of the mounting bracket. When the mounting flanges are fitted together, tightening the locking screw with the lips in engagement with each other causes the mounting flanges to be clamped together and fixes the drawer casing in position on the mounting flange. When the locking screw is loosened, the drawer can be slid transversely along the mounting bracket or it can be removed entirely.

Desirably, a pair of mounting brackets and a pair of drawer casing flanges are positioned at the front and the back portions of the drawer to provide support for the front and the back of the drawer. A single locking screw and clamp bracket at the front of the drawer are sufficient to hold both brackets in place.

A similar bracket and attachment mechanism is formed on the underside of each drawer or storage unit, so that additional drawer or storage units can be added to the underside of the first drawer or storage unit after it is mounted on a work surface.

The drawer or storage units also can be mounted together in the same manner to form a pedestal unit employing drawers or file storage space, with top surfaces and pedestal bases being attached in the same manner.

A stack of drawers of the type used for a pedestal work surface also can be employed on opposite sides of an elongated work surface in order to form a desk unit wherein the work surface is supported by a stack of drawers on each side thereof.

These and other features of the present invention are described in detail below and shown in the appended drawings.

DETAILED DESCRIPTION OF PREFERRED EMBODIMENT

Figure 1:
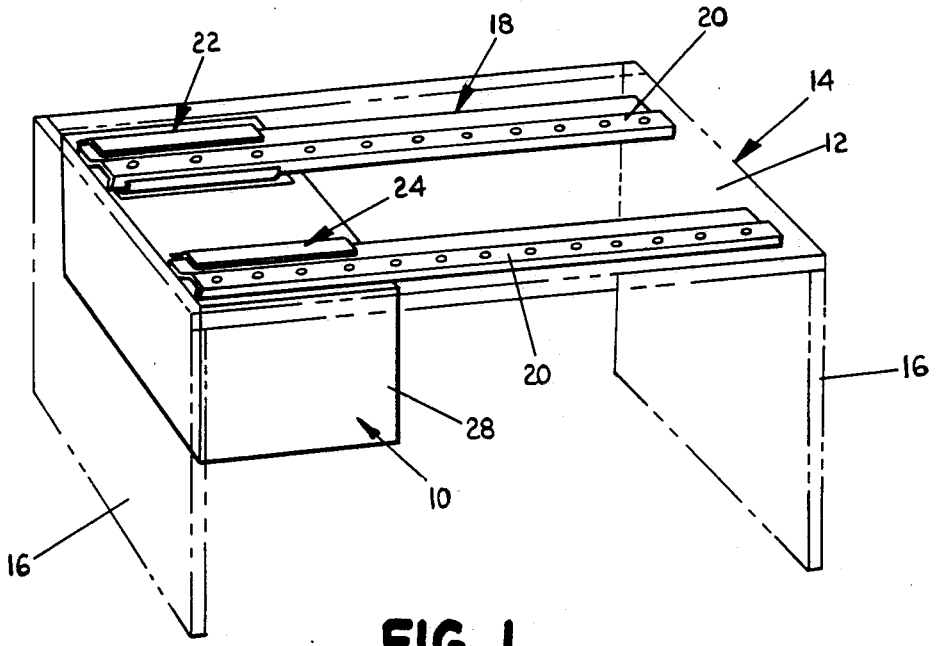
FIG. 1 is a perspective view of a desk employing the modular drawer system of the present invention, with the view taken from the rear corner of the desk.

Referring to the drawings, a drawer unit 10 is shown mounted on the underside of a work surface 12 of a desk 14 in FIG. 1. Desk 14 also includes vertical sides 16. The desk is conventional.

Drawer unit 10 is mounted on the underside of work surface 12 by means of a mounting mechanism 18 constructed in accordance with the present invention. Mounting mechanism 18 includes a pair of transversely mounted mounting brackets 20 mounted at the front and rear portions of the desk. These mounting brackets engage mating mounting brackets 22 and 24 on the front and rear portions of the upper surface of the drawer unit.

Drawer unit 10 comprises a drawer 26 mounted for inward and outward movement in a generally rectangular drawer casing 28. Drawer casing 28 comprises an upper and lower side and sidewalls enclosing the drawer. A conventional drawer guide (not shown) suspends the drawer in the drawer casing.

Figure 2:
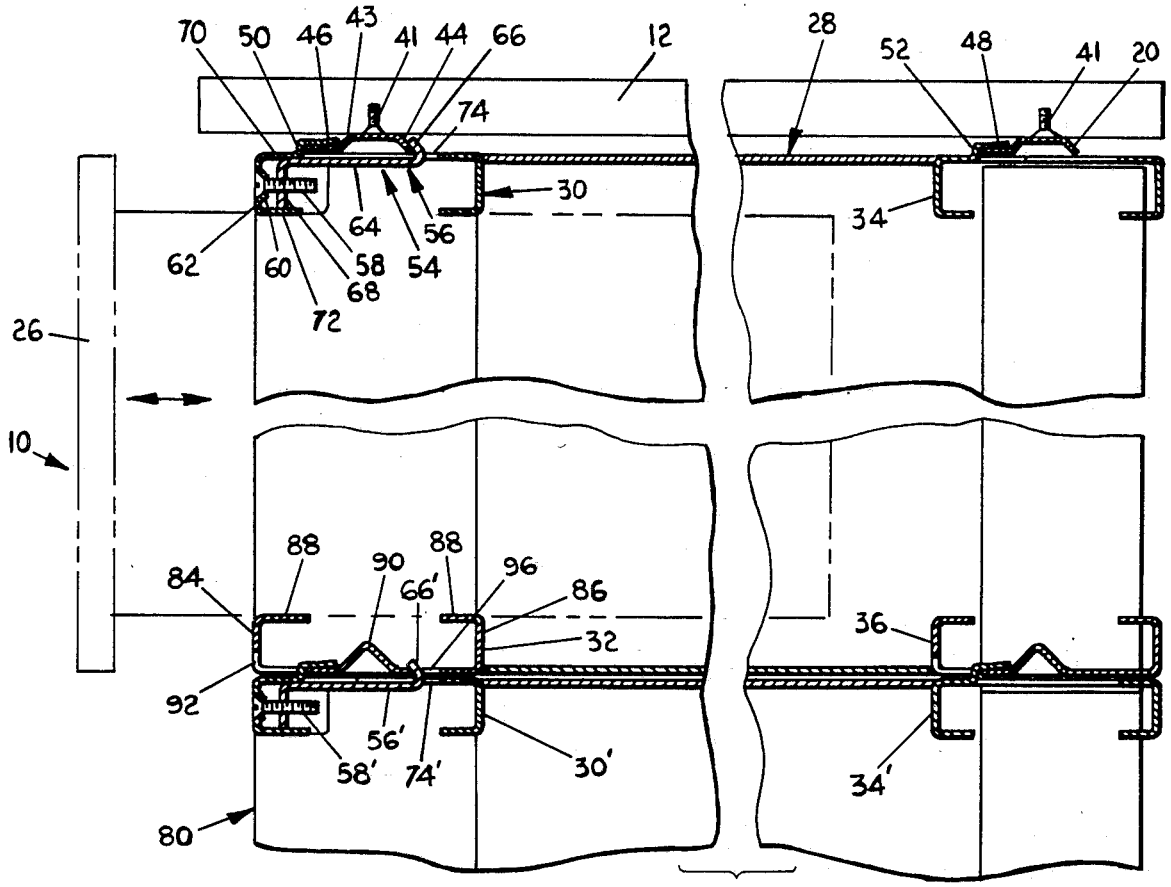
FIG. 2 is a sectional side elevational view of the storage unit mounting mechanism of the present invention.

As shown in FIG. 2, drawer casing 28 comprises a reinforcing channel member surrounding the drawer opening at the front of the drawer casing and surrounding the rear portion of the drawer casing, with the channel member having an upper channel 30 and a lower channel 32 extending across the top and bottom of the drawer casing at the front of the drawer casing. Similar channels 34 and 36 extend across the upper and lower portions of the rear end of the drawer casing.

Figure 5:
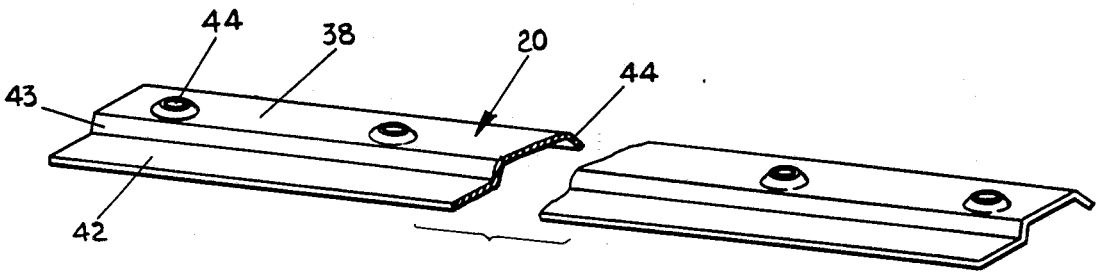
FIG. 5 is a perspective view of the mounting flange of the present invention.

As shown in FIG. 5, each mounting bracket 20 comprises an elongated member preferably formed of stamped sheet steel. Desirably, 16 gauge steel is used. Each mounting bracket 20 comprises an upper portion 38 that is mounted flat against the underside of the work surface in the transverse position shown in FIG. 1. The upper portion includes a plurality of chamferred openings 40 which receive fasteners 41 (FIG. 2) for attaching the mounting bracket to the underside of the work surface.

The mounting bracket also includes a mounting bracket flange 42 that extends outwardly and preferably horizontally from one of the elongated side edges of the mounting bracket. Mounting bracket flange 42 is positioned below the upper surface of upper portion 48 so that there is a space above flange 42 for receipt of a complementary mating flange of the drawer casing. Mounting bracket flange 42 is connected to the upper portion 38 by means of a downwardly extending side wall 43. As shown in FIG. 1, mounting bracket flange 42 desirably extends forwardly in a generally horizontal plane toward the front of the desk (to the left in FIG. 2 orientation). The flange could be inclined downwardly and inwardly to urge a similarly inclined flange on the drawer casing into mating relationship. The whole arrangement also could be reversed, with the mounting bracket flange extending rearwardly, provided that all of the other flanges are repositioned accordingly.

The rear edge of the mounting bracket includes a downwardly and outwardly extending lip 44 that extends at about a 45° angle downwardly from the upper portion for a distance of about one eighth inch or more. This lip extends downwardly substantially the same distance as side wall 43 that interconnects the mounting bracket flange and the upper portion. Lip 44 and flange 42 run the entire length of the mounting bracket, and the mounting bracket desirably has a uniform cross sectional shape and configuration.

As shown in FIG. 1, a pair of mounting brackets are mounted at the front and rear portions of the work surface, with the mounting bracket flanges 42 extending forwardly in both cases.

The drawer casing is mounted on the mounting bracket flanges by means of mating drawer casing flanges 46 and 48 that extend upwardly and rearwardly from channels 30 and 34 respectively. Desirably, these flanges are horizontal and are stamped out of the channels. Vertical legs 50 and 52 interconnecting the upper channel members with the drawer casing flanges cause the flanges to be spaced above the upper surface of channels 30 and 34.

As shown in FIG. 2, the drawer casing can be fitted on to mounting bracket 20 by lifting the drawer casing up so that it abuts the bottom of the mounting bracket, with the flanges on the drawer casing spaced forwardly of and facing the mounting bracket flanges on the mounting bracket. The drawer casing can then be slid rearwardly so that the flanges overlap and interfit. When in this position, the drawer casing will be suspended from the mounting bracket.

In order to lock the drawer casing on the mounting bracket, a retainer 54 in the form of a clamping bracket extends between the drawer casing and the mounting bracket and holds the flanges in interfitting position. Retainer 54 could engage the underside of the work surface instead of the mounting bracket and accomplish the same holding function, but the inner-engagement with the mounting bracket if preferred.

Retainer 54 comprises a clamp bracket 56 and a locking screw 58. Locking screw 58 engages a tapered opening 60 in the front surface 62 of channel 30. Locking screw 58 is rotatable in the opening but is restrained by the tapered opening 60 against axial movement through the opening. Clamp bracket 56 includes a horizontal arm 64 with an upwardly extending lip 66 at an inner or right end (FIG. 2 orientation) of the clamping bracket. Lip 66 desirably is curved backwards at an acute angle of 45° so that it mates with the 45° lip on the rear edge of the mounting flange.

The front portion of the clamp bracket includes a downwardly extending flange 68 that fits relatively closely between the upper surface 70 of channel 30 and a lower parallel surface 72 of channel 30. Flange 68 has a threaded opening therein that mates with locking screw 58. Clamp bracket 56 is restrained against rotatable movement by channel 30 so rotation of locking screw 58 causes axial movement of clamp bracket 56 in an inward or outward direction (to the right and to the left in FIG. 2 orientation).

Lip 66 of clamp bracket 56 fits through an opening 74 in the upper surface of channel 30 so that it can engage and hold lip 44 of the mounting bracket.

No corresponding locking screw is needed to hold the rear flanges in engagement, since they engage and disengage with each other simultaneously with the front flanges.

As is evident from the foregoing, a drawer casing can be mounted and dismounted from the mounting brackets with complete ease. Locking screw 58 is simply loosened a sufficient distance so that flange 46 of the drawer casing can fit over flange 42 of the mounting bracket. When the flanges have been fitted together, the lip on the clamping bracket is fitted over lip 44 of the mounting bracket and locking screw 58 is tightened. A partial tightening of locking screw 58 permits the drawer unit to be slid sideways along mounting bracket 20 so that the drawer unit can easily be placed on the right-hand side or the left-hand side of the desk. When the desired position is achieved, the locking screw is further tightened to clamp the drawer unit in its desired transverse position on the mounting brackets.

As shown in FIG. 2, using this same type of mounting bracket arrangement, additional drawer or storage units can be mounted on the bottom of drawer unit 10. In FIG. 2 a second drawer unit 80 is mounted on the underside of drawer unit 10. Drawer unit 80 has upper channels 30' and 34', upper drawer casing flanges 46' and 48' and a retainer or clamp mechanism 54' that are all identical to the components used for drawer unit 10. The front and back channels 30 and 34 and 32 and 36 are identified in all embodiments except for the presence of the retainer or clamp in the front channel. Bottom channel 32 of drawer unit 10 is similar in shape to mounting bracket 20. Bottom channel 32 includes a bottom 82, front and rear sides 84 and 86, and inwardly extending flanges 88 on the upper ends of sides 84 and 86. An indented portion 90 having a V-shaped cross section is formed at the middle of the bottom of channel 32. An opening 92 is formed at the front of channel 32, with the opening extending rearwardly from the lower front edge of channel 32 and partially upwardly into side 84. This opening accommodates flange 46' and permits the flange to fit through the opening and over a flange 94 formed by the portion of the bottom of channel 32 immediately to the rear of opening 92. Another opening 96 is formed in the bottom of channel 32 toward the rear portion of the channel. This accommodates lip 66' of the clamp bracket for locking the drawer casing for drawer unit 80 in position on the underside of drawer unit 10.

Figure 3:
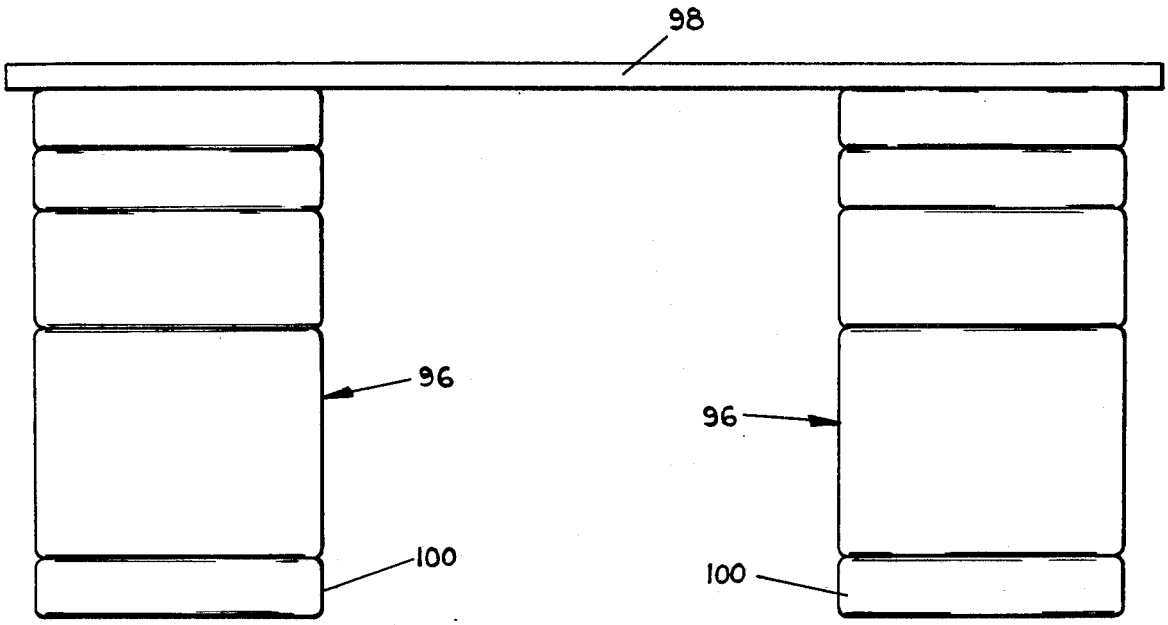
FIG. 3 is a front elevational view of a desk unit employing stacks of modular storage units on each side of the work surface as a pedestal base for the work surface.
Figure 4:
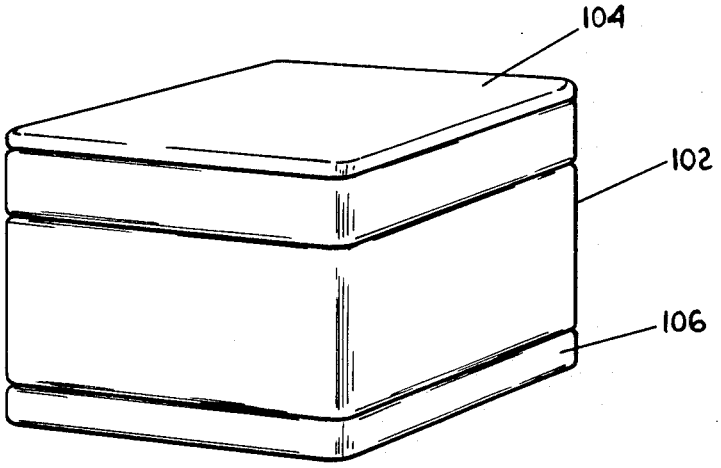
FIG. 4 is a perspective schematic view of a pedestal work unit of the present invention, employing a top and pedestal base attached with the mounting mechanism of the present invention.

As shown in FIGS. 3 and 4, any number of drawer units can be locked together in this manner, either to suspend the drawer units from the underside of a work space or to form free standing work spaces and storage units. In FIG. 3, two stacks 96 of drawer units, interconnected in the manner set forth above, are positioned on opposite sides of a horizontal work surface 98 and serve as supports for the work surface. A pedestal base 100 for each column of storage units is attached to the storage units in the same manner as the storage units are attached to each other.

In FIG. 4, a series of storage units are connected together to form a pedestal arrangement 102 with its own independent work surface 104 mounted on the top of the upper unit. Work surface 104 can be fixed to the upper unit or releasably mounted to the upper unit in the manner described above. A pedestal base 106 can be attached in a similar manner.

One of the important advantages of the mounting mechanism of the present invention is that it provides complete flexibility in mounting various storage units together while at the same time markedly facilitating the ease with which such storage units can be connected together and moved in a sideways direction on the underside of a work surface. This is believed to be a substantial improvement in the types of mounting mechanisms heretofore known.

It should be understood that the foregoing is merely exemplary of the preferred practice of the present invention and that various changes and modifications may be made in the arrangements and details of construction of the embodiment shown without departing from the spirit and scope of the present invention, as defined in the appended claims.

We claim:

1. A mounting mechanism for movably and releasably mounting a drawer unit on the underside of a work surface, wherein the drawer unit comprises a drawer movably mounted in a drawer casing that has upper and lower sides, the mounting mechanism comprising:

an elongated mounting bracket that is affixed transversely to the underside of a work surface, the mounting bracket having a mounting bracket flange extending outwardly from one side and spaced away from the work surface so another flange can fit over the mounting flange;

a mating upper drawer casing flange on the upper side of the drawer casing and facing the mounting bracket flange, the upper drawer casing flange fitting over the mounting bracket flange by sliding the drawer casing flange sideways toward the mounting bracket flange with the drawer casing lifted upwardly to a position adjacent the side of the mounting bracket with the flanges facing each other; and releasable retainer means for releasably holding the flanges in overlapping engagement with each other, said retainer means engaging the drawer casing and one of the mounting bracket and underside of the work surface and preventing the drawer casing flange from sliding away from overlapping engagement with the mounting bracket flange in a direction perpendicular to the side of the mounting bracket, the retainer means comprising an adjustable position clamp slidably mounted in the drawer casing on the opposite side of the mounting flange from the drawer casing flange, the clamp position being adjustable in one direction to draw the drawer casing flange toward the mounting bracket flange so as to lock the drawer casing on the mounting bracket flange, the clamp being adjustable in the opposite direction to permit the drawer casing to be slipped transversely along the mounting bracket or removed from the mounting bracket.

2. A mounting mechanism according to claim 1 wherein the clamp comprises a clamp bracket slidably mounted in the drawer casing and having one end attached to the drawer casing by means of an axially rotatable threaded fastener that is mounted in the front of the drawer casing with a rotatable head positioned on the outer side of the drawer casing in a position that is accessible when the drawer is open but concealed when the drawer is closed, the threaded fastener being restrained from inward axial movement with respect to the drawer casing, the clamp bracket being threaded on the fastener by a threaded opening in the clamp bracket and being non-rotatable such that rotation of the threaded fastener causes axial movement of the clamp bracket, the clamp bracket including gripping means for gripping the mounting bracket when the clamp bracket is tightened on the mounting bracket.

3. A mounting mechanism according to claim 2 wherein the mounting bracket has a downwardly and outwardly extending lip on the side opposite the mounting bracket flange, the clamp bracket having an upwardly extending outer lip formed at an acute angle such that it fits over the lip on the mounting bracket.

4. A mounting mechanism according to claim 1 wherein the mounting mechanism includes a pair of mounting brackets and drawer casing mounting flanges mounted at the front and rear portions of the drawer casing, with both sets of flanges occupying the same relative positions with respect to the mating flanges, both mounting bracket flanges facing the same direction, and both drawer casing flanges facing the same direction, such that both sets of flanges are engaged and overlapped simultaneously when the drawer casing is brought upwardly to the mounting flanges and the flanges are slid toward each other in a direction perpendicular to the elongated side of the mounting bracket.

5. A mounting mechanism according to claim 1 and further comprising a lower drawer casing flange on the bottom of each drawer casing that is shaped and positioned to engage the upper drawer casing flange of a drawer placed beneath the drawer in substantially the same manner as the mounting bracket flange engages the upper drawer casing flange for a drawer unit mounted on underside of a work surface, the lower side of the casing also being formed to engage the retainer means for a lower drawer unit to lock the lower drawer unit on the one above.

6. A modular storage unit comprising a plurality of individual drawer units wherein drawers are mounted in drawer casings that enclose the drawers and have upper and lower sides, the drawer casings stacking on one another to form a column of drawer units, each drawer unit having on the upper side upper drawer casing flange means facing in one direction and on the lower side lower drawer casing flange means facing in an opposite direction, the flanges being generally horizontal and positioned such that an upper drawer unit can be mounted on a lower drawer unit by placing the upper unit on the lower unit with the flanges offset side by side and facing each other and then sliding the flanges together, the flanges interfitting when slid together, one of the upper and lower sides of the drawer casing including an adjustable retainer means for holding the interfitted upper and lower drawer units together, the retainer means extending between the two drawer casings and being releasable from at least one drawer casing, the retainer means being tightenable to urge the flanges into interfitting engagement so as to prevent the flanges from sliding outwardly apart, the retaining means being releasable to permit the drawer units to be separated, the retainer means including easily accessible adjustment means for tightening and releasing the retainer means, the adjustment means being an inwardly extending threaded fastener having a head positioned at the front of the casing, the head being concealed behind the face of the drawer when the drawer is closed but being accessible for rotation when the drawer is opened, the fastener being rotatable but not axially movable in the casing.

7. A mounting mechanism for releasably mounting a drawer unit on the underside of a work surface wherein the drawer unit comprises a slidable drawer mounted in a drawer casing, the mounting mechanism comprising:

at least one elongated mounting bracket mounted transversely on the underside of the work surface, the mounting bracket having transversely extending continuous mounting bracket flanges extending outwardly from the mounting bracket in opposite directions, the mounting flanges being spaced below the underside of the work surface;

a drawer casing flange that has an upper surface that extends outwardly and mates with one of the mounting bracket flanges;

a clamp slidably mounted in the drawer casing for movement in a direction perpendicular to the transverse position of the mounting bracket, the clamp having a clamp flange that fits over and mates with the other mounting bracket flange; and a threaded fastener means rotatably mounted in the drawer casing in a fixed axial position, the threaded fastener means extending in a direction perpendicular to the side of the mounting bracket and engaging a threaded opening in the clamp, rotation of the threaded fastener in one direction causing the clamp to be drawn toward the drawer casing flange so as to clamp the drawer casing on the mounting bracket, the drawer casing being locked in a fixed position on the mounting bracket when the threaded fastener is tightened, partial loosening of the threaded fastener permitting the drawer casing to be slid longitudinally along the mounting bracket to any desired position, further loosening of the threaded fastener means separating the clamp from the drawer casing flange sufficiently that the drawer casing can be removed completely from the mounting bracket.

8. A mounting mechanism according to claim 7 wherein the fastener extends through an opening in a front portion of the drawer casing, said front portion being concealed behind the face of the drawer when the drawer is closed, the head of the fastener being positioned on the outside of the drawer casing, the threaded fastener extending through the opening and into threaded engagement with the clamp, rotation of the threaded fastener in one direction drawing the clamp toward the front of the drawer casing, the drawer casing flange extending rearwardly over the front edge of the mounting bracket flange, such that drawing the clamp toward the front of the drawer casing clamps the drawer casing on the mounting bracket.

9. A mounting mechanism according to claim 7 wherein the mechanism includes two parallel mounting brackets mounted on the underside of the work surface, with one of the mounting brackets being positioned adjacent the rear of the drawer casing and the other bracket being positioned adjacent the front of the drawer casing, the clamp and threaded fastener engaging the mounting bracket at the front of the drawer casing, the drawer casing having mounting flanges that engage both the front and the back mounting brackets.

* * * * *